US009891649B2

(12) United States Patent
Isobe

(10) Patent No.: US 9,891,649 B2
(45) Date of Patent: Feb. 13, 2018

(54) VOLTAGE REGULATOR

(71) Applicant: SII Semiconductor Corporation, Chiba-shi, Chiba (JP)

(72) Inventor: Yoshihisa Isobe, Kumamoto (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 15/403,867

(22) Filed: Jan. 11, 2017

(65) Prior Publication Data

US 2017/0205843 A1 Jul. 20, 2017

(30) Foreign Application Priority Data

Jan. 18, 2016 (JP) ..... 2016-007340

(51) Int. Cl.
*G05F 3/08* (2006.01)
*G05F 3/26* (2006.01)

(52) U.S. Cl.
CPC ..... *G05F 3/262* (2013.01)

(58) Field of Classification Search
CPC combination set(s) only.
See application file for complete search history.

(56) References Cited

U.S. PATENT DOCUMENTS 7,646,188 B2 * 1/2010 Suzuki ..... G05F 1/56 323/222
2015/0036249 A1 * 2/2015 Tian ..... H02H 3/027 361/57

FOREIGN PATENT DOCUMENTS

JP 2008-204018 A 9/2008

* cited by examiner

*Primary Examiner* — Adolf Berhane
*Assistant Examiner* — Afework Demisse
(74) *Attorney, Agent, or Firm* — Brinks Gilson & Lione

(57) ABSTRACT

A safe and low-cost voltage regulator is provided through simplification of a circuit configuration of a protection circuit. The voltage regulator has a configuration in which current output of the protection circuit, which serves as a signal indicating that the protection circuit has started to operate, is input to a control circuit configured to improve responsiveness of the voltage regulator.

3 Claims, 3 Drawing Sheets

VOLTAGE REGULATOR

RELATED APPLICATIONS

This application claims priority under 35 U.S.C. § 119 to Japanese Patent Application No. 2016-007340 filed on Jan. 18, 2016, the entire content of which is hereby incorporated by reference.

BACKGROUND OF THE INVENTION

1. Field of the Invention

The present invention relates to a voltage regulator including a protection circuit.

The present application claims priority based on Japanese Patent Application No. 2016-007340 filed in Japan on Jan. 18, 2016, the disclosures of which are incorporated herein by reference in their entirety.

2. Description of the Related Art

In general, electronic devices such as cellular phones are configured to operate with rechargeable batteries. A voltage regulator is provided to the battery such that an output voltage to the electronic device does not fluctuate and the electronic device stably operates, even when a charged state of the battery fluctuates. Further, the voltage regulator, which is configured to prevent the output voltage to the electronic device from fluctuating such that the electronic device stably operates even when a load of the electronic device sharply fluctuates, is provided with a control circuit for achieving a more stable output voltage of the voltage regulator in some cases.

FIG. 3 is a circuit diagram of a related-art voltage regulator 30. The voltage regulator 30 includes an output transistor 31 configured to output an output voltage VOUT, voltage-dividing resistors 32 for dividing the output voltage VOUT such that a divided voltage VFB is output, an error amplifier circuit 35 configured to operate to match the divided voltage VFB with a reference voltage VREF, and control the output transistor 31 such that the output voltage VOUT is constant, a protection circuit 33 configured to protect the voltage regulator 30, and a control circuit 34 configured to detect fluctuation in output voltage VOUT to operate to stabilize the output voltage VOUT.

The protection circuit 33 is configured to detect failure including, for example, a case in which an excessive current flows through the output transistor 31, and output a signal at a power supply voltage level to perform control for turning off the output transistor 31.

The control circuit 34 is configured to detect decrease in output voltage VOUT to perform control for turning off the output transistor 31.

Here, the control circuit 34 is configured to stop its operation when receiving the signal at the power supply voltage level that indicates that the protection circuit 33 has started to operate. Thus, when the output voltage VOUT is decreased through control by the protection circuit 33, the output voltage VOUT is not increased through operation of the control circuit 34. As a result, safety of the voltage regulator is increased (for example, see Japanese Patent Application Laid-open No. 2008-204018).

However, the protection circuit 33 only has an analog signal having an intermediate potential, as means for detecting failure, such as a voltage. Thus, for the protection circuit 33, a circuit configured to convert an output signal being an analog signal into a digital signal is required.

SUMMARY OF THE INVENTION

The present invention has been made in order to solve the problem described above, and achieves a safe and low-cost voltage regulator through simplification of the circuit configuration of a protection circuit.

In order to solve the related-art problem, a voltage regulator according to one embodiment of the present invention has the following configuration.

The voltage regulator includes: an output transistor configured to output an output voltage; a voltage divider circuit configured to generate a divided voltage by dividing the output voltage, and output the divided voltage; an error amplifier circuit configured to compare a reference voltage and the divided voltage to each other, to thereby control a gate of the output transistor such that the output voltage is constant; a protection circuit configured to protect circuits of the voltage regulator by controlling the gate of the output transistor, when a predetermined condition is satisfied; and a control circuit configured to operate to stabilize the output voltage when the output voltage fluctuates, and stop operation of the control circuit when receiving a signal indicating that the protection circuit has started to operate, the signal indicating that the protection circuit has started to operate being current output.

According to the voltage regulator of the present invention, the current output of the protection circuit serves as an output signal thereof that indicates that the protection circuit has started to operate, and hence the circuit configuration of the protection circuit can be simplified. As a result, there is provided an effect that the safe and low-cost voltage regulator can be achieved.

In addition, the output current of the protection circuit, which indicates that the protection circuit has started to operate, is a drain current of the transistor whose gate and source are common with those of the transistor configured to control the gate of the output transistor of the voltage regulator, or a current that is generated by the current mirror circuit configured to receive the drain current as input. As a result, there is provided an effect that the safe voltage regulator can be achieved through addition of a few elements.

DETAILED DESCRIPTION OF THE PREFERRED EMBODIMENTS

Now, embodiments of the present invention are described with reference to the drawings.

Figure 1:
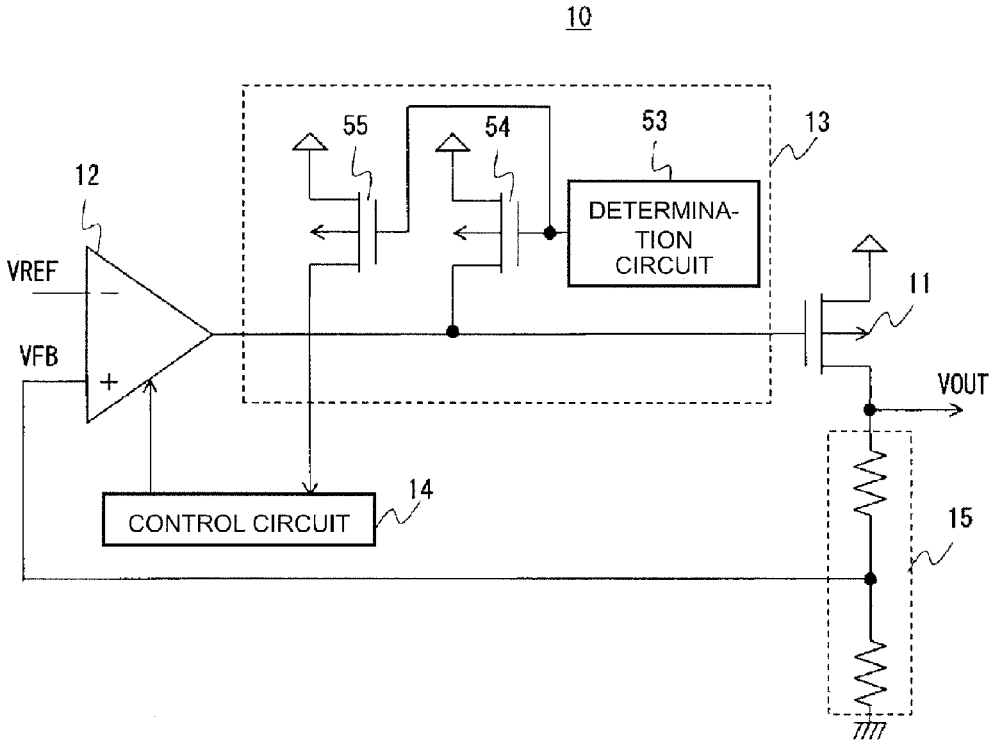
FIG. 1 is a circuit diagram for illustrating an example of a voltage regulator according to an embodiment of the present invention.

FIG. 1 is a circuit diagram for illustrating an example of a voltage regulator according to an embodiment of the present invention.

The voltage regulator of this embodiment includes an output transistor 11 being a PMOS transistor configured to output an output voltage VOUT, voltage-dividing resistors 15 for dividing the output voltage VOUT such that a divided voltage VFB is output, an error amplifier circuit 12 configured to operate to match the divided voltage VFB with a reference voltage VREF, and control the output transistor 11 such that the output voltage VOUT is constant, a protection circuit 13 configured to protect the voltage regulator, and a control circuit 14 configured to detect fluctuation in power supply voltage or output voltage VOUT to operate to stabilize the output voltage VOUT by controlling the error amplifier circuit 12.

The protection circuit 13 includes a determination circuit 53 configured to determine whether or not a predetermined condition is satisfied under which protection of the voltage regulator is required, a PMOS transistor 54 having a gate that is controlled by the determination circuit 53 and being configured to control a gate voltage of the output transistor 11, and a PMOS transistor 55 having a gate that is controlled by the determination circuit 53 and being configured to output a current as output of the protection circuit 13 when the predetermined condition is satisfied.

The control circuit 14 is configured to stop its operation when receiving the output current of the protection circuit 13 that indicates that the protection circuit 13 has started to operate due to satisfaction of the predetermined condition.

The voltage regulator as described above is configured to operate as follows to enhance its safety when the protection circuit operates.

The protection circuit 13 determines, with the determination circuit 53, whether or not the predetermined condition is satisfied under which protection of the voltage regulator is required, such as an overcurrent state or an overheated state, and increases the gate voltage of the output transistor 11 of the voltage regulator with a current of the PMOS transistor 54 that is caused to flow through control of the gate of the PMOS transistor 54, to thereby decrease a current flowing through the output transistor 11. As a result, the output voltage VOUT decreases.

At this time, if the control circuit 14 detects the decrease in output voltage VOUT to control the error amplifier circuit 12, thereby operating to return the output voltage VOUT to a predetermined voltage, the error amplifier circuit 12 operates to decrease the gate voltage of the output transistor 11. Consequently, the current flowing through the output transistor 11 increases to impair the safety of the voltage regulator. However, because the control circuit 14 of the voltage regulator of this embodiment is configured to stop its operation when receiving the output current output from the PMOS transistor 55 that indicates that the protection circuit 13 has started to operate, a current controlled by the protection circuit 13 flows through the output transistor 11.

As described above, according to the voltage regulator of this embodiment, current output of the protection circuit 13 serves as an output signal thereof that indicates that the protection circuit 13 has started to operate. Thus, even when the protection circuit only has an analog signal having an intermediate potential of a power supply voltage and a ground voltage, there is no need to provide a circuit configured to generate from the analog signal a digital signal only taking the power supply voltage or the ground voltage except for a transition state of the signal. As a result, there is provided an effect that the safe voltage regulator may be achieved through addition of a few elements.

In particular, the output current of the protection circuit 13, which indicates that the protection circuit 13 has started to operate, is a drain current of the transistor 55 whose gate and source are in common with those of the transistor 54 configured to control the gate of the output transistor 11 of the voltage regulator. As a result, the safe voltage regulator may be achieved through addition of only one element.

Figure 2:
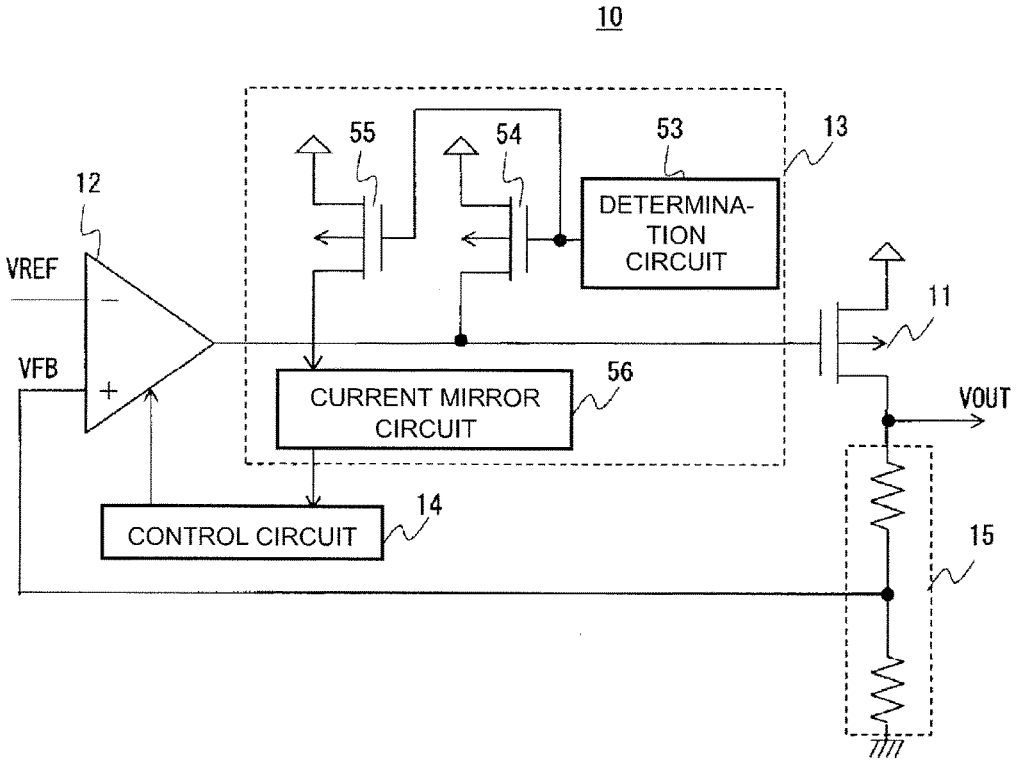
FIG. 2 is a circuit diagram for illustrating a voltage regulator according to another embodiment of the present invention.
Figure 3:
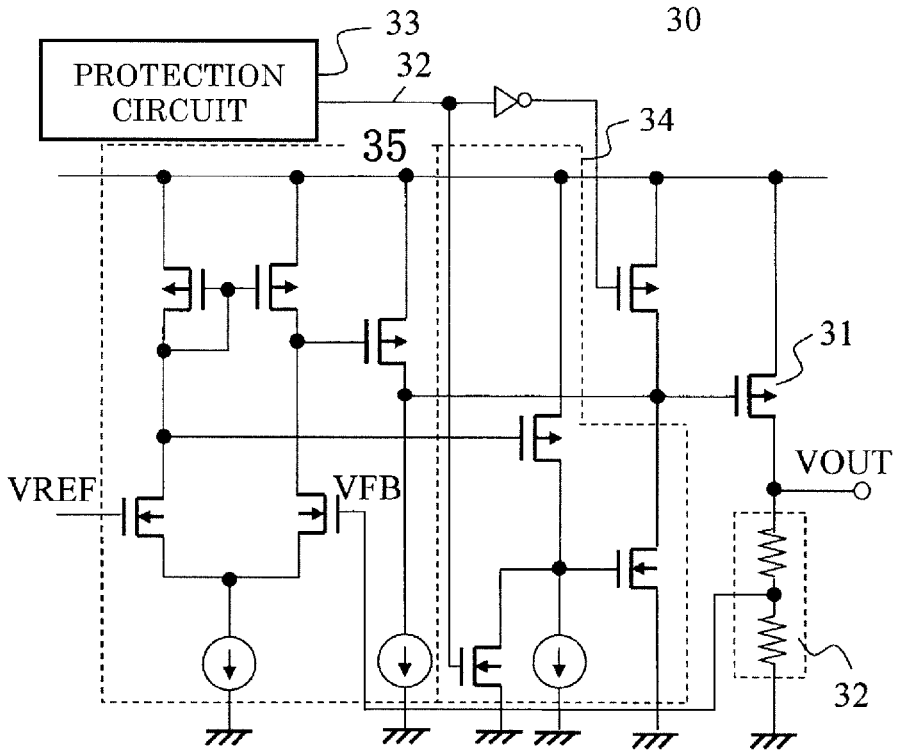
FIG. 3 PRIOR ART
FIG. 3 is a circuit diagram of a related-art voltage regulator.

FIG. 2 is a circuit diagram for illustrating a voltage regulator according to another embodiment of the present invention. A protection circuit 13 of the voltage regulator of FIG. 2 includes a current mirror circuit 56. An output current indicating that the protection circuit 13 has started to operate is an output current of the current mirror circuit 56 configured to receive a drain current of a PMOS transistor 55 as input.

As generally and widely known among those skilled in the art, the current mirror circuit 56 has a function of performing conversion of a current value, and a function of converting a direction of current from a source current into a sink current, or from a sink current into a source current.

As described above, according to the voltage regulator of this embodiment, an appropriate amount of current may be output in an appropriate direction depending on the circuit form of the control circuit 14 configured to operate to stabilize the output voltage VOUT, or on a contact point of the control circuit 14 at which the output current that is output from the protection circuit 13 is input.

What is claimed is:

1. A voltage regulator, comprising:

an output transistor configured to output an output voltage;

a voltage divider circuit configured to generate a divided voltage by dividing the output voltage, and output the divided voltage;

an error amplifier circuit configured to compare a reference voltage and the divided voltage to each other, to thereby control a gate of the output transistor such that the output voltage is constant;

a protection circuit configured to protect circuits of the voltage regulator by controlling the gate of the output transistor via a first transistor, when a predetermined condition is satisfied; and a control circuit configured to operate to stabilize the output voltage when the output voltage fluctuates, and stop operation of the control circuit when receiving a signal indicating that the protection circuit has started to operate, the signal indicating that the protection circuit has started to operate comprising current output;

wherein the current output corresponds to a drain current of a second transistor whose gate and source are in common with those of the first transistor configured to control the gate of the output transistor.

2. A voltage regulator, comprising:

an output transistor configured to output an output voltage;

a voltage divider circuit configured to generate a divided voltage by dividing the output voltage, and output the divided voltage;

an error amplifier circuit configured to compare a reference voltage and the divided voltage to each other, to thereby control a gate of the output transistor such that the output voltage is constant;

a protection circuit configured to protect circuits of the voltage regulator by controlling the gate of the output transistor, when a predetermined condition is satisfied; and a control circuit configured to operate to stabilize the output voltage when the output voltage fluctuates, and stop operation of the control circuit when receiving a signal indicating that the protection circuit has started to operate, the signal indicating that the protection circuit has started to operate comprising current output;

wherein the protection circuit comprises:

a determination circuit configured to determine whether or not the predetermined condition is satisfied;

a first MOS transistor configured to receive an output voltage of the determination circuit to control the gate of the output transistor; and a second MOS transistor configured to receive the output voltage of the determination circuit to output the signal indicating that the protection circuit has started to operate.

3. The voltage regulator according to claim 2, wherein the protection circuit further comprises a current mirror circuit configured to receive an output current of the second MOS transistor as input.

* * * * *